US008703501B2

(12) United States Patent
Mead et al.

(10) Patent No.: US 8,703,501 B2
(45) Date of Patent: Apr. 22, 2014

(54) DIRECTED ASSEMBLY OF A CONDUCTING POLYMER

(75) Inventors: Joey L. Mead, Carlisle, MA (US); Carol M. F. Barry, Tyngsboro, MA (US); Ahmed Busnaina, Ashland, MA (US); Ming Wei, Lowell, MA (US); Zhenghong Tao, Spring Lake, NJ (US)

(73) Assignee: Northeastern University, Boston, MA (US)

( * ) Notice: Subject to any disclaimer, the term of this patent is extended or adjusted under 35 U.S.C. 154(b) by 1005 days.

(21) Appl. No.: 11/921,715

(22) PCT Filed: Jun. 7, 2006

(86) PCT No.: PCT/US2006/022070

§ 371 (c)(1),
(2), (4) Date: Dec. 6, 2007

(87) PCT Pub. No.: WO2006/133265

PCT Pub. Date: Dec. 14, 2006

(65) Prior Publication Data

US 2009/0134033 A1 May 28, 2009

Related U.S. Application Data

(60) Provisional application No. 60/688,028, filed on Jun. 7, 2005.

(51) Int. Cl.
*G01N 25/18* (2006.01)
*C25D 5/54* (2006.01)

(52) U.S. Cl.
USPC ..... 436/149; 436/151; 205/78; 204/471

(58) Field of Classification Search
USPC ..... 205/78; 204/471; 436/149, 151
See application file for complete search history.

(56) References Cited

U.S. PATENT DOCUMENTS 6,492,096 B1 12/2002 Liu et al.
2007/0134930 A1 * 6/2007 Hastwell et al. ..... 438/758

FOREIGN PATENT DOCUMENTS

WO WO 2005/041319 5/2005

OTHER PUBLICATIONS

Copper-Assisted Weak Polyelectrolyte Multilayer Formation on Microspheres and Subsequent Film Crosslinking Peter Schuetz, Frank Caruso Adv. Funct. Mater. 2003. 13, No. 12.*

(Continued)

*Primary Examiner* — Krishnan S Menon
*Assistant Examiner* — Dwan A Gerido
(74) *Attorney, Agent, or Firm* — McLane, Graf, Raulerson & Middleton, PA

(57) ABSTRACT

The present invention provides a method for directed assembly of a conducting polymer. A method of the invention comprises providing a template such as an insulated template and electrophorectically assembling a conducting polymer thereon. Preferably, the template comprises a patterned electrode on which the conducting polymer is assembled. Moreover, the invention provides a method for transferring an assembled conducting polymer. For example, a method of the invention comprises providing a substrate such as a polymeric substrate and contacting a surface thereof with an assembled conducting polymer. The assembled conducting polymer can be disposed on a patterned electrode of a template, hi one embodiment, a method comprises removing the substrate. By removing the substrate, the assembled conducting polymer is transferred from the patterned electrode of the template to the substrate. The invention also provides a device with a template or substrate comprising an assembled conducting polymer.

11 Claims, 13 Drawing Sheets

(56) References Cited

OTHER PUBLICATIONS

Deposition of polyaniline on micro-contact printed self-assembled monolayers of w-functionalized alkanethiols Curtis N. Sayre and David M. Collard J. Mater. Chem., 1997, 7(6), 909-912.*

Investigation of contact and bulk resistance of conducting polymers by simultaneous two and four point technique Qingli Hao, Valentin Kulikov, Vladimir M. Mirsky Sensors and Actuators B 94 (2003) 352-357.*

Kraus, T. Closing the gap between self-assembly and Microsystems using self-assembly, transfer, and integration of particles. *Advanced Materials.* vol. 17, pp. 2438-2442; 2005.

Li, G. Controlled electrophoretic patterning of polyaniline from a colloidal suspension. *J. Am. Chem. Soc.* vol. 127, pp. 4903-4909; 2005.

Winkleman, A. Directed self-assembly of spherical particles on patterned electrodes by an applied electric field. *Advanced Materials.* vol. 17, pp. 1507-1511; 2005.

* cited by examiner

DIRECTED ASSEMBLY OF A CONDUCTING POLYMER

CROSS-REFERENCE TO RELATED APPLICATIONS

This application claims the priority of U.S. Provisional Application No. 60/688,028 filed Jun. 7, 2005 and entitled ASSEMBLY OF POLYMERS USING ELECTROSTATICALLY ADDRESSABLE TEMPLATES, the contents of which are hereby incorporated by reference herein.

STATEMENT REGARDING FEDERALLY SPONSORED RESEARCH OR DEVELOPMENT

Part of the work leading to the present invention was carried out with United States Government support provided under Grant No. NSF-0425826 awarded by the National Science Foundation. Thus, the United States Government has certain rights in the invention as described herein.

BACKGROUND OF THE INVENTION

The unique electronic properties of conducting polymers have garnered considerable research interest as potential alternatives to metals and conventional semiconductor materials due, in part, to their flexibility and processing ease. M. Angelopoulos, IBM J. Res. Dev., 2001, 45, 57. In addition, many conducting polymers such as poly(aniline) (PANi) exhibit pH and redox sensitivity, which can significantly affect their optical spectra in the visible region. A. Bossi et al., Electrophoresis, 2003, 24, 3356. The potential application of conducting polymers in micro and nanoelectronic or optical devices has also fostered commercial interest. For example, conducting polymers may be used in the fabrication of devices such as field effect transistors (FET), paper-like and colorful thin displays, organic photovoltaic cells, plastic circuits and biosensors. J. Rogers et al., Journal of Polymer Science: Part A: Polymer Chemistry, 2002, 40, 3327; S. Forrest, Nature, 2004, 428, 911.

Several approaches have also been taken to pattern conducting polymers on micro or nanomaterials for research and commercial interests. In general, these approaches are based on direct or indirect patterning techniques. Direct patterning techniques to deposit a conducting polymer onto a material include methods such as ink jet printing, screen printing and soft-lithography. Similarly, indirect patterning techniques involve polymerizing a conducting polymer during patterning by using electropolymerization on microcontact printed self-assembled monolayers, thin polymer brushes or scanning electrochemical microscopes. Although both direct and indirect patterning techniques have been used to fabricate devices that feature conducting polymers, they are not without their shortcomings. Exemplary shortcomings related to these techniques include complex and slow monomer polymerization, low resolution and yields or harsh environments required for electropolymerization.

Furthermore, patterning of conducting polymers alone may not be sufficient to fabricate certain types of organic devices. Such organic devices can require that a patterned conducting polymer be able to be transferred onto a substrate. Current approaches for transferring patterned conducting polymers on the micro or nanoscale tend to be inefficient, involving multiple steps or separate materials for patterning and transferring. Thus, there remains a significant need to develop less complicated and more effective approaches to patterning and transferring conducting polymers on the micro and nanoscale. T. Kraus et al., Adv. Mater., 2005, 17, 2438; A. Winkleman et al., Adv. Mater., 2005, 17, 1507.

SUMMARY OF THE INVENTION

The present invention provides a method for directed assembly of a conducting polymer. In one embodiment, a method of the invention comprises providing a template and electrophorectically assembling a conducting polymer thereon. Preferably, the template comprises a patterned electrode on which the conducting polymer is assembled. Exemplary conducting polymers for assembly on a template can include, without limitation, poly(styrenesulfonate)-poly(2,3-dihydrothieno(3,4-1,4-dioxin) (PEDOT), poly(acetylene), poly(diacetylene), poly(pyrrole), PANi, poly(thiophene), poly(p-phenylene), poly(azulene), poly(quinoline) and combinations thereof. The patterned electrode of a template for a method of the invention can comprise one or more conducting materials. These conducting materials can include, for example, metals or semiconductors such as gold, silver, chromium, gallium, silicon, ruthenium, titanium, tungsten and platinum. The invention also contemplates partially or substantially assembling the conducting polymer on the patterned electrode of the template.

A template for a method of the invention can also be insulated or sufficiently insulated and comprise one or more conducting materials. Exemplary conducting materials include, without limitation, metals or semiconductors such as gold, silver, chromium, gallium, silicon, ruthenium, titanium, tungsten and platinum. Furthermore, a template for a method of the invention can be fabricated by conventional processes. In one embodiment, an insulated template for a method of the invention can be fabricated by depositing an insulator on a suitable wafer such as a silicon wafer. For example, the insulator can comprise silicon dioxide thermally grown on a wafer. Standard processes can be used to deposit one or more metal or semiconductor layers on the insulator. An etch process such as photolithography or electron beam lithography can also be used to form a patterned electrode of a template. The patterned electrode comprises one or more metals or semiconductors from the deposited layers and can include a raised or trenched topography depending on the etch process.

Moreover, a patterned electrode of a template for a method of the invention can include metal lines that comprise a raised topography. The metal lines of the patterned electrode can comprise widths on the micro or nanoscale. Exemplary widths for a metal line of a patterned electrode can be from about 10 nanometers (nm) to 1,000 microns (μm). A method of the invention also includes connecting the patterned electrode of the template to a power source. The power source can be capable of negatively and positively charging the patterned electrode for electrophorectically assembling a conducting polymer thereon. In one embodiment, the power source can negatively charge the patterned electrode of the template and positively charge a separate electrode. Preferably, a method of the invention involves immersing a template into a solution comprising a conducting polymer and charging the patterned electrode of the template by applying a voltage from the power source to provide for an electric field. The patterned electrode of the template electrophorectically attracts an oppositely charged conducting polymer, which directs assembly of the polymer on the electrode.

Preferably, the invention provides a method for transferring an assembled conducting polymer. A method of the invention comprises providing a substrate such as a polymeric substrate and contacting a surface of the substrate with an assembled conducting polymer. The assembled conducting polymer can be disposed on a patterned electrode of a template. In one embodiment, a method comprises removing the substrate. The substrate can be removed from its relative adjacency to the template. By removing the substrate, the assembled conducting polymer can be transferred, for example, completely transferred, from a patterned electrode of a template to the substrate. The invention also contemplates partially or substantially transferring the assembled conducting polymer to the substrate.

In one embodiment, a method for transferring an assembled conducting polymer comprises contacting an assembled conducting polymer with a polymeric substrate. For example, the substrate can be compressed and heated to cure or evaporate solvents that are associated therewith. Preferably, the substrate can be cooled and peeled away from the assembled conducting polymer disposed on a patterned electrode of a template. The substrate can also be cast onto the assembled conducting polymer as a solution. A person of ordinary skill in the art can select a polymeric substrate such that the assembled conducting polymer adheres thereto more strongly than to the template. The assembled conducting polymer can then be transferred to the substrate in a pattern that corresponds to the patterned electrode of the template on which the polymer was assembled.

Furthermore, a method of the invention can comprise providing a template such as an insulated template and electrophorectically assembling a conducting polymer thereon. For example, the template can be sufficiently insulated. Preferably, the template comprises a patterned electrode on which the conducting polymer is assembled. A method also comprises providing a substrate such as a polymeric substrate and contacting a surface thereof with the assembled conducting polymer disposed on the template. In one embodiment, the substrate can be provided as a solution capable of solidifying through, without limitation, curing, temperature reduction, vulcanization or evaporation of solvents associated therewith. The substrate can also be removed, transferring the polymer from the patterned electrode of the template to the surface of the substrate.

A method of the invention can comprise transferring an assembled conducting polymer disposed on a template by a molding process, for example, an injection molding process. Exemplary molding processes including those that are standard to a person of ordinary skill in the art and variations thereof, which can be used for nanomanufacturing. In one embodiment, a method comprises introducing the template into a mold. Moreover, a method of the invention comprises injecting a polymeric material into the mold and, subsequently, ejecting the material. During ejection of the polymeric material, the assembled conducting polymer can be transferred thereto. A person of ordinary skill in the art can select polymeric materials such that the assembled conducting polymer adheres thereto more strongly than to the template. Alternatively, the substrate can be cast onto an assembled conducting polymer using an extrusion process. Solution coating processes can also be used to deposit a material for the substrate on an assembled conducting polymer. The invention contemplates that such processes can be performed continuously for a method of the invention.

The invention also provides a method for directed assembly of a polyelectrolyte or polar polymer. A method of the invention comprises providing a template such as an insulated or sufficiently insulated template and electrophorectically assembling a polyelectrolyte or polar polymer thereon. Preferably, the template comprises a patterned electrode on which the polyelectrolyte or polar polymer is assembled. In one embodiment, the invention provides a method for transferring an assembled polyelectrolyte or polar polymer. For example, a method of the invention comprises providing a substrate such as a polymeric substrate and contacting a surface thereof with an assembled polyelectrolyte or polar polymer. The assembled polyelectrolyte or polar polymer can be disposed on a patterned electrode of a template. A method of the invention also comprises removing the substrate such as from its relative adjacency to the template. By removing the substrate, the assembled polyelectrolyte or polar polymer can be transferred from a patterned electrode of a template to the substrate. The invention also contemplates partially or substantially assembling the polyelectrolyte or polar polymer on the patterned electrode of the template and partially or substantially transferring it to the substrate.

In one embodiment, a method of the invention comprises providing a template on which a polyelectrolyte or polar polymer can be disposed. Preferably, the polyelectrolyte or polar polymer are disposed uniformly on a surface of the template, which includes a patterned electrode connected to a power source. The power source can be capable of negatively and positively charging the electrode of the template. Moreover, a method comprises melting the polyelectrolyte or polar polymer disposed on the template. For example, the template can be heated to temperatures suitable for melting the polyelectrolyte or polar polymer thereon. A method of the invention also comprises introducing the template and polyelectrolyte or polar polymer to heat source such as, without limitation, a conventional oven.

For example, a method of the invention includes depositing a polyelectrolyte or polar polymer onto a template that comprises a patterned electrode. The patterned electrode of the template can be connected to a power source for negatively or positively charging the electrode. In one embodiment, the template and polyelectrolyte or polar polymer are introduced to a conventional oven for melting the polyelectrolyte or polar polymer. As the polyelectrolyte or polar polymer melts, the power source charges the patterned electrode of the template to assemble the polyelectrolyte or polar polymer thereon. Preferably, the patterned electrode of the template can be charged by the power source such that oppositely charged polyelectrolytes or polar polymers are assembled thereon. The polyelectrolyte or polar polymer can also be annealed during or after assembly on the patterned electrode of the template.

Exemplary polyelectrolytes for a method of the invention include, without limitation, poly(acrylic acid), poly(allylamine hydrochloride), polyamidoamine, poly(ethylene imine), poly(thiophene acetic acid), poly(azobenzene), poly (p-phenylene vinylene), sulfonated polystyrene, poly(methacrylic acid), poly(vinyl pyrrolidone), poly(vinyl sulfonic acid) and combinations thereof. In one embodiment, the invention provides a device comprising a template. The template can comprise a patterned electrode on which an electrophorectically assembled conducting polymer, polyelectrolyte or polar polymer can be disposed. Preferably, the template of a device of the invention is insulated or sufficiently insulated. Such a device can be assembled by a method of the invention. A device of the invention can also comprise an assembled conducting polymer, polyelectrolyte, polar polymer or combinations thereof disposed on a patterned electrode of a template.

The invention also provides a device comprising a substrate such as a polymeric substrate. Preferably, the substrate comprises a surface on which an electrophorectically assembled conducting polymer, polyelectrolyte or polar polymer can be disposed. In one embodiment, the assembled conducting polymer, polyelectrolyte or polar polymer of the device corresponds to a pattern transferred from a template. For example, a device of the invention can include lines of a conducting polymer, polyelectrolyte or polar polymer that comprise a raised topography. An exemplary device can be assembled by a method of the invention. A device of the invention can, for example, comprise a FET, paper-like or colorful thin display, organic photovoltaic cell, plastic circuit or biosensor. The invention also contemplates devices comprising one or more conducting polymers, polyelectrolytes, polar polymers or combinations thereof.

DESCRIPTION OF THE DRAWINGS

Other features and advantages of the invention may also be apparent from the following detailed description thereof, taken in conjunction with the accompanying drawings of which.

DETAILED DESCRIPTION OF THE INVENTION

The invention provides a method for directed assembly of a conducting polymer. A method of the invention comprises providing a template such as an insulated template and electrophorectically assembling a conducting polymer thereon. Preferably, the template comprises a patterned electrode on which the conducting polymer is assembled. In one embodiment, a method of the invention includes providing an insulated or sufficiently insulated template, which comprises a patterned electrode. The patterned electrode of the template can be connected to a power source capable of negatively and positively charging the electrode. A method of the invention also includes immersing a template into a solution comprising a conducting polymer and charging the patterned electrode of the template by applying a voltage from the power source to provide for an electric field. The patterned electrode of the template electrophorectically attracts an oppositely charged conducting polymer, which directs assembly of the polymer on the electrode.

Figure 1:
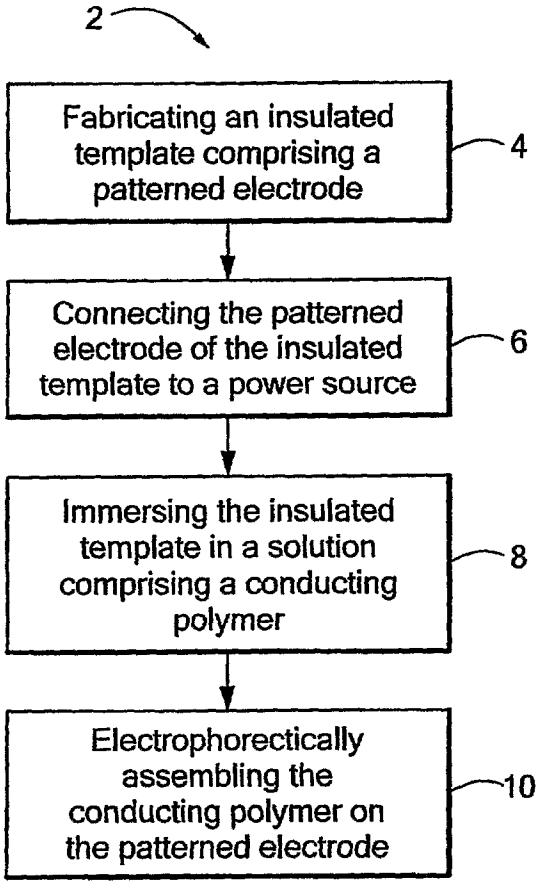
FIG. 1 represents an exemplary method of the invention for directed assembly of a conducting polymer.

FIG. 1 represents an exemplary method of the invention for directed assembly of a conducting polymer. As shown, the method 2 comprises fabricating an insulated template in step 4. In one embodiment, the insulated template can be fabricated by depositing an insulator on a suitable wafer such as a silicon, sapphire or silicon carbide wafer. For example, the insulator can comprise silicon dioxide thermally grown as a layer. Alternatively, the insulated template can comprise a silicon dioxide wafer. Fabricating the insulated template can also include depositing one or more metal or semiconductor layers on the insulator. Exemplary metal or semiconductor layers include gold, silver, chromium, gallium, silicon, ruthenium, titanium, tungsten and platinum. Standard processes can be used to deposit one or more metal or semiconductor layers on the insulator. Preferably, the insulated template comprises a chromium layer deposited on the insulator. The insulated template can also comprise a gold layer deposited on the chromium layer.

After depositing one or more metal or semiconductor layers, a patterned electrode can be formed by conventional processes. For example, the patterned electrode can be formed through an etch process such as photolithography or electron beam lithography. In one embodiment, the patterned electrode comprises one or more metals or semiconductors from the deposited layers and can include a raised or trenched topography depending on the etch process. The raised or trenched topography of the patterned electrode can comprise dimensions such as widths, heights or depths on the micro or nanoscale. Preferably, the patterned electrode of the insulated template can include metal lines that comprise a raised topography. The metal lines can be spaced from, without limitation, about 10 nm to 1,000 μm apart and comprise widths on the micro or nanoscale.

The method 2 of FIG. 1 includes connecting the patterned electrode of the insulated template to a power source in step 6. The power source can be capable of negatively and positively charging the electrode for electrophorectically assembling a conducting polymer thereon. For example, the patterned electrode of the insulated template can be negatively charged by the power source to electrophorectically attract a positively charged conducting polymer, polyelectrolyte, polar polymer or combination thereof. Alternatively, the patterned electrode of the template can be connected to a power source capable of charging the electrode and oppositely charging a separate electrode to provide an electric field for electrophorectic assembly of a conducting polymer. The method of FIG. 1 also comprises immersing the insulated template into a solution comprising a conducting polymer in step 8. Preferably, the solution can comprise a conducting polymer, polyelectrolyte, polar polymer or combination thereof. With the insulated template immersed in solution, the patterned electrode provides for an electric field. In one embodiment, the power source can negatively charge the patterned electrode of the insulated template and positively charge a separate electrode to provide for an electric field.

As shown, the method 2 of FIG. 1 includes electrophorectically assembling the conducting polymer within solution on the patterned electrode of the insulated template in step 10. Preferably, the patterned electrode of the insulated template comprises gold, which can be negatively charged. In one embodiment, the patterned electrode can be negatively charged by the power source to electrophorectically attract PANi for its directed assembly on the electrode. The invention also contemplates partially or substantially assembling the conducting polymer on the patterned electrode of the insulted template. The method of FIG. 1 can also be performed to assemble a device of the invention comprising an assembled conducting polymer, polyelectrolyte, polar polymer or combination thereof.

In one embodiment, a template for a method of the invention can be sufficiently insulated. Preferably, the template can be sufficiently insulated to provide for selective electrophoretic assembly of a conducting polymer on a patterned electrode of the template. For example, with the template being sufficiently insulated, assembly of the conducting polymer can occur selectively on its patterned electrode. A device of the invention can also include a sufficiently insulated template on which a conducting polymer is selectively and electrophoretically assembled. The invention contemplates assembly of the conducting polymer exclusively on the patterned electrode of the template.

Figure 2:
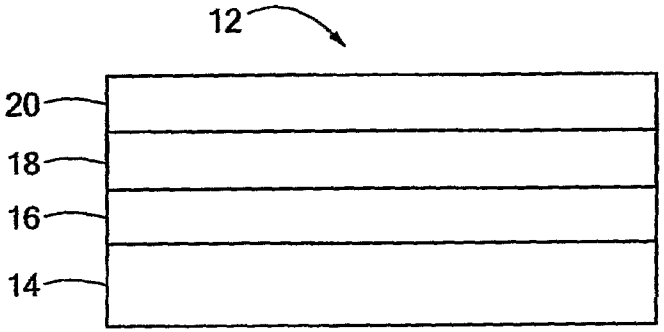
FIG. 2 represents an exemplary insulated template for a method of the invention prior to forming a patterned electrode.

FIG. 2 represents an exemplary insulated template for a method of the invention prior to forming a patterned electrode. As shown, the insulated template 12 comprises a wafer 14 such as a silicon, sapphire or silicon carbide wafer. In one embodiment, the wafer of the template can comprise silicon. The template of FIG. 2 also comprises an insulator 16 disposed on the wafer. For example, the insulator can comprise silicon dioxide deposited or grown as a layer to provide for a sufficiently insulated template. Moreover, the insulated template can include a first layer 18 disposed on the insulator. A second layer 20 can also be disposed on the first layer of the template. Exemplary layers for the template comprise metals or semiconductors such as gold, silver, chromium, gallium, silicon, ruthenium, titanium, tungsten and platinum. Preferably, the first and second layers of the template comprise chromium and gold, respectively. A patterned electrode can be formed in the insulated template for a method of the invention through standard processes such as etch processes.

Figure 3:
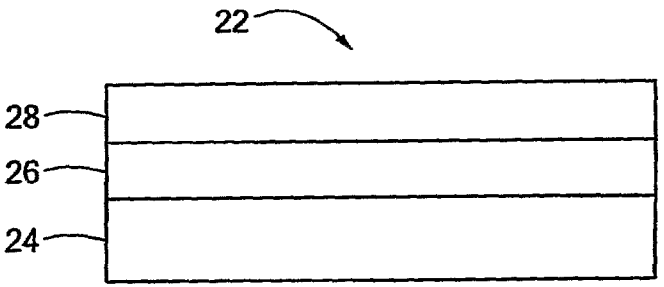
FIG. 3 represents an exemplary template for a method of the invention prior to forming a patterned electrode.

Similarly, FIG. 3 represents an exemplary template for a method of the invention prior to forming a patterned electrode. As shown, the template 22 comprises a wafer 24 such as a silicon, sapphire or silicon carbide wafer. Alternatively, the template can be an insulated or sufficiently insulated template comprising a silicon dioxide wafer. In one embodiment, the wafer of the template can comprise silicon. The template of FIG. 2 also can include a first layer 26 disposed on the wafer. A second layer 28 can also be disposed on the first layer of the template. Exemplary layers for the template comprise metals or semiconductors such as gold, silver, chromium, gallium, silicon, ruthenium, titanium, tungsten and platinum. Preferably, the first and second layers of the template comprise chromium and gold, respectively. A patterned electrode can be formed in the template for a method of the invention through standard processes such as etch processes.

Figure 4:
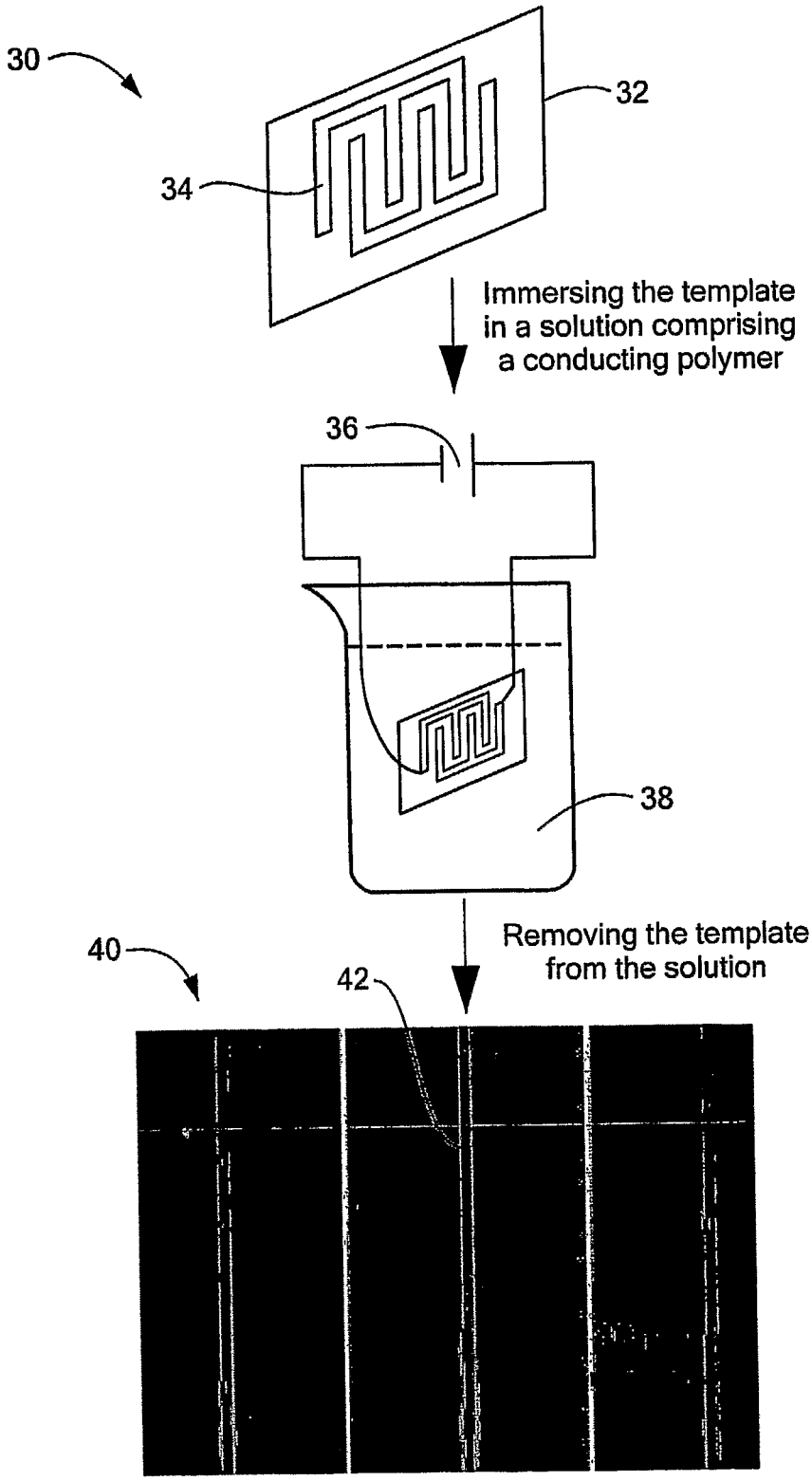
FIG. 4 represents an exemplary method and device of the invention.

A device of the invention can include a template with a patterned electrode comprising a conducting polymer, polyelectrolyte, polar polymer or combination thereof assembled thereon. FIG. 4 represents an exemplary method and device of the invention. As shown, the method 30 comprises providing a template 32 with a patterned electrode 34. For example, the template can be an insulated template comprising a silicon dioxide wafer. In one embodiment, the template comprises a silicon dioxide insulator disposed on a silicon wafer. An exemplary silicon dioxide insulator can be about 150 nm thick. A chromium layer is also disposed on the silicon dioxide insulator onto which a gold layer can be deposited. Preferably, the chromium and gold layers can be, without limitation, about 6 and 40 nm thick, respectively. Through an etch process employing a photoresist and photomask, the gold layer can provide for the patterned electrode of the template. The patterned electrode of FIG. 4 comprises interdigitated raised gold lines, each with a width of about 2 μm and spaced about 55 μm apart.

The patterned electrode 34 of the template 32 can be connected to a power source 36 capable of negatively and positively charging the electrode by providing a voltage. Exemplary power sources include conventional alternating and direct current (DC) sources such as a battery. In one embodiment, interdigitated raised gold lines of the template are alternatingly charged by the power source to comprise negative and positive electrodes for directed assembly of a conducting polymer. Depending on the charge of a conducting polymer, the invention contemplates that assembly thereof can occur on either a positively or negatively charged patterned electrode of the template. The method 30 of FIG. 4 also comprises immersing the template in a solution 38 comprising a conducting polymer.

In one embodiment, a solution for a method of the invention can include a conducting polymer, polyelectrolyte, polar polymer or combination thereof. Preferably, the solution can be an aqueous solution. For example, an aqueous solution can comprise, without limitation, solvents, acids, conducting polymers, bases, polyelectrolytes, salts, monomers, polymers, electrolytes or combinations thereof such as dimethylformamide (DMF), dimethylsulfoxide (DMSO), PEDOT, poly(acetylene), poly(diacetylene), poly(pyrrole), PANi, poly(thiophene), poly(p-phenylene), poly(azulene), poly (quinoline), camphorsulfonic acid (CSA), polystyrene, dicumyl peroxide (DCP), emeraldine base polymers, poly (acrylic acid), poly(allylamine hydrochloride), polyamidoamine, poly(ethylene imine), poly(thiophene acetic acid), poly(azobenzene), poly(p-phenylene vinylene), sulfonated polystyrene, poly(methacrylic acid), poly(vinyl pyrrolidone) and poly(vinyl sulfonic acid), emeraldine base conducting polymers, polar polymers and water. An exemplary solution for a method of the invention comprises DMF, emeraldine base PANi and CSA.

Preferably, the power source 36 for the method 30 of FIG. 4 can be employed to both negatively and positively charge the patterned electrode 34 of the template 32. By negatively and positively charging the patterned electrode, an electric field can be provided such that the conducting polymer in solution 38 electrophorectically assembles on the electrode. After assembly of the conducting polymer on the patterned electrode, the method can include removing the template from solution and disconnecting the power source therefrom. The assembly of the conducting polymer on the patterned electrode of the template yields a device 40 of the invention. As shown, the device comprises PANi 42 assembled on the template with widths on the microscale. In one embodiment, PANi can be assembled on the patterned electrode of the template. The invention also contemplates partially or substantially assembling PANi on the patterned electrode of the template.

Figure 5:
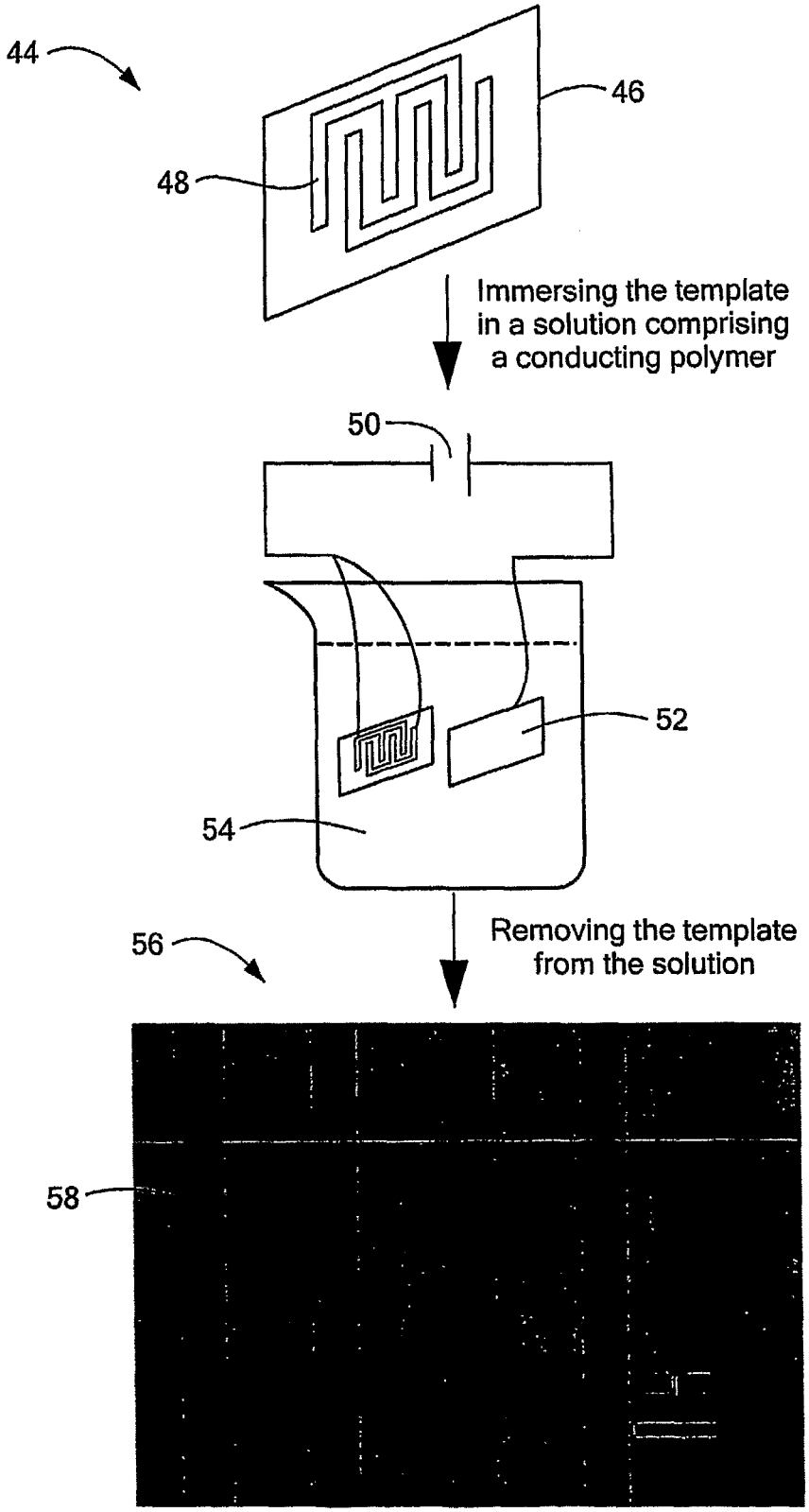
FIG. 5 represents an exemplary method and device of the invention.

FIG. 5 represents an exemplary method and device of the invention. As shown, the method 44 comprises providing a template 46 with a patterned electrode 48. For example, the template can be an insulated or sufficiently insulated template comprising a silicon dioxide wafer. In one embodiment, the template comprises a silicon dioxide insulator disposed on a silicon wafer. An exemplary silicon dioxide insulator can be about 150 nm thick. A chromium layer is also disposed on the silicon dioxide insulator onto which a gold layer can be deposited. Preferably, the chromium and gold layers can be, without limitation, about 6 and 40 nm thick, respectively. Through an etch process employing a photoresist and photomask, the gold layer can provide for the patterned electrode of the template. The patterned electrode of FIG. 5 comprises interdigitated raised gold lines, each with a width of about 2 μm and spaced about 55 μm apart.

The patterned electrode 48 of the template 46 can also be connected to a power source 50 capable of charging the electrode and oppositely charging a separate electrode 52 by providing a voltage. Exemplary power sources include conventional alternating and DC sources such as a battery. Preferably, interdigitated raised gold lines of the patterned electrode for the template are negatively charged by the power source for directed assembled of a conducting polymer thereon. With the patterned electrode negatively charged, the separate electrode can be positively charged using the power source. Depending on the charge of a conducting polymer, the invention contemplates that assembly thereof can occur on either a positively or negatively charged patterned electrode of the template with the separate electrode comprising an opposite charge. In one embodiment, the invention contemplates using multiple power sources to provide an electric field for electrophorectically assembling a conducting polymer. The invention also contemplates directed assembly of a conducting polymer, polyelectrolyte, polar polymer or combination thereof on one or more patterned electrodes or templates.

The method 44 of FIG. 5 also comprises immersing the template 46 in a solution 54 comprising a conducting polymer. As shown, the power source 50 negatively charges the patterned electrode 48 of the template and positively charges the separate electrode 52. By oppositely charging the electrodes, an electric field can be provided such that the conducting polymer in solution 54 electrophorectically assembles on the patterned electrode. After assembly of the conducting polymer on the patterned electrode, the method can include removing the template from solution and disconnecting the power source therefrom. The assembly of the conducting polymer on the patterned electrode of the template yields a device 56 of the invention. The device comprises PANi 58 assembled on the template with widths on the microscale. In one embodiment, PANi can be assembled on the patterned electrode of the template. The invention also contemplates partially or substantially assembling PANi on the patterned electrode of the template.

Furthermore, a device of the invention comprises PANi electrophorectically assembled on a patterned electrode of a template that can be insulated or sufficiently insulated. Preferably, PANi can be assembled on a patterned electrode comprising raised gold lines, each with a width of about 2 μm and spaced about 55 μm apart. For example, FIG. 6 comprises an OM image of electrophorectically assembled PANi disposed on a patterned electrode of an insulated template. As shown, the insulated template 60 includes a patterned electrode comprising interdigitated raised gold lines 62, each with a width of about 2 μm and spaced about 55 μm apart. In one embodiment, a method of the invention can be performed to alternatingly charge the interdigitated raised gold lines of the template in a solution comprising DMF, emeraldine base PANi and CSA. The interdigitated raised gold lines can be alternatingly positively and negatively charged by a power source to provide an electric field in solution for the electrophoretic assembly of PANi 64 onto those lines that are negatively charged. The invention also contemplates controlling the electrophoretic assembly of PANi by varying parameters such as, for example, electric field strength, deposition time and solution dielectric constants.

Figure 6:
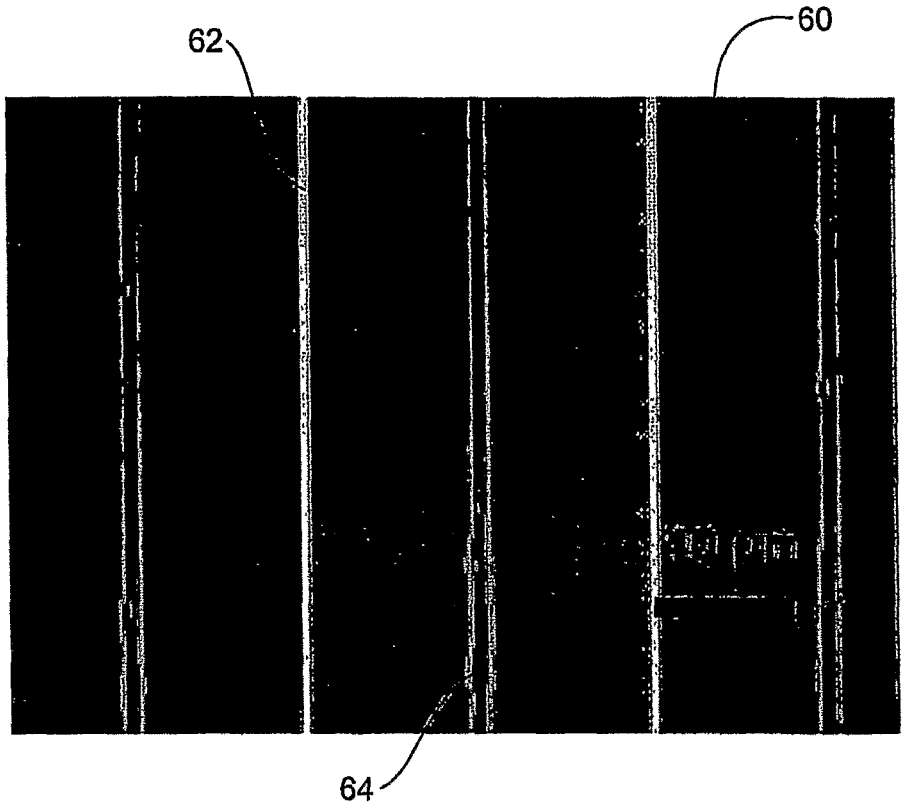
FIG. 6 comprises an optical microscope (OM) image of electrophorectically assembled PANi disposed on a patterned electrode of an insulated template.

As shown, PANi 64 can be electrophorectically assembled on the negatively charged interdigitated raised gold lines of FIG. 6 under an applied voltage of about 10 V from a power source. FIG. 6 also indicates that electrophorectic assembly of PANi occurs entirely or substantially on the oppositely charged interdigitated raised gold lines during a deposition time of about 1 min. By comparison, conventional approaches to assembling polymers do not direct deposition to specific areas or features of a device. For example, these approaches are generally limited to coating entire devices with a polymer. Without being bound by theory, conventional approaches for assembling polymers tend to coat an entire device with a polymer due to current leakage. In order for assembly to occur selectively on a patterned electrode of a template for a method of the invention, the template can be sufficiently insulated to prevent deposition thereon. Moreover, for a method of the invention to obtain consistent assembly of a conducting polymer, the patterned electrode can apply a sufficient electrostatic field. The template 60 of FIG. 6 can comprise a device of the invention.

Figure 7:
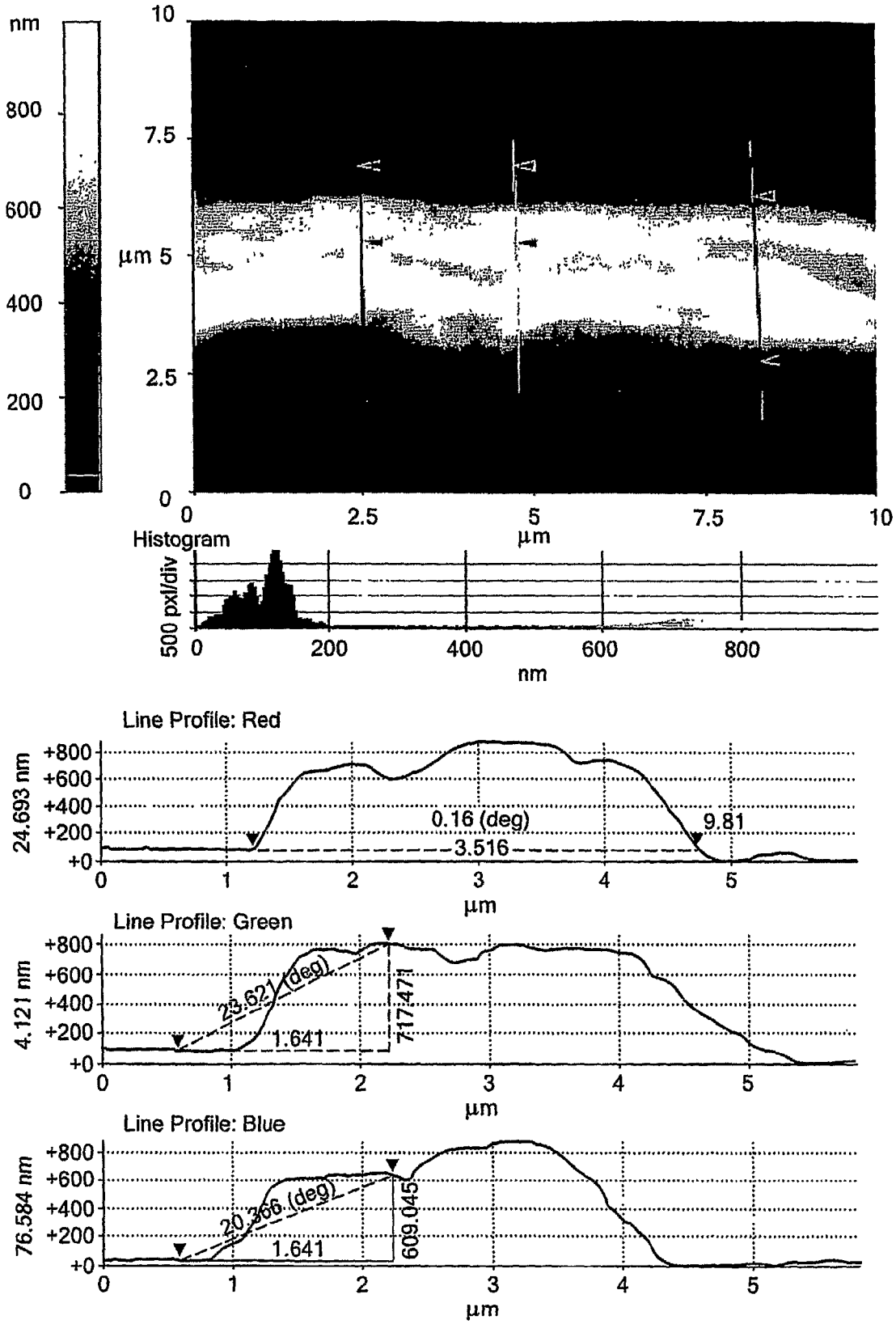
FIG. 7 comprises atomic force microscope (AFM) images of electrophorectically assembled PANi on the insulated template in FIG. 6.

FIG. 7 comprises AFM images of electrophorectically assembled PANi on the insulated template in FIG. 6. The AFM images represent electrophoretically assembled PANi on an individual negatively charged interdigitated raised gold line of the patterned electrode for the template. As shown, PANi is substantially uniform in its assembly along the length of the negatively charged interdigitated raised gold line. Moreover, the assembled PANi is predominately centered across the width of the negatively charged interdigitated raised gold line. For example, the electrophorectically assembled PANi comprises a width from about 2 to 4.5 μm and height from about 200 to 850 nm. The topography profiles of FIG. 7 also indicate relative uniformity of PANi assembly along the length of the negatively charged interdigitated raised gold line.

Figure 8:
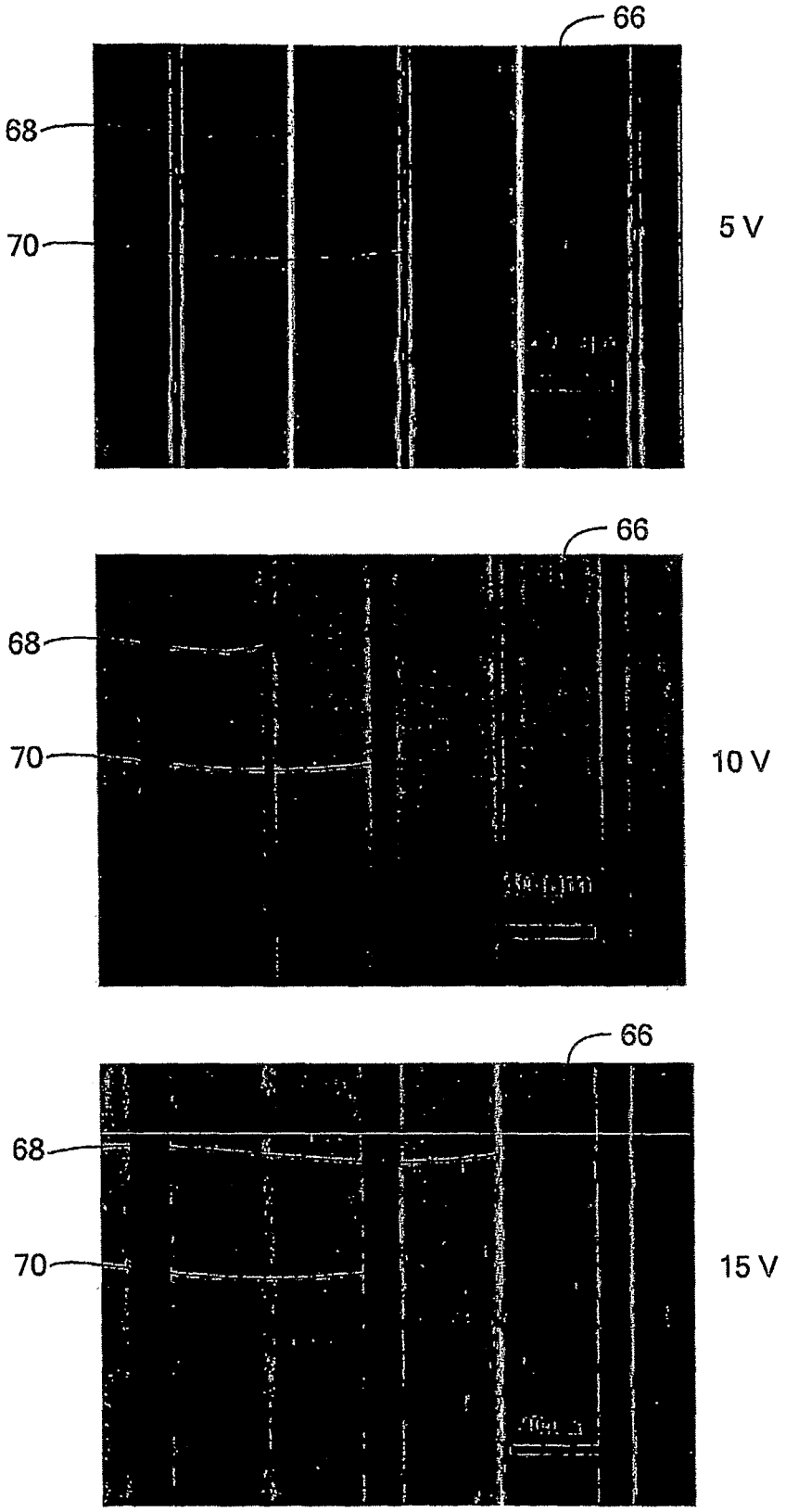
FIG. 8 comprises OM images of electrophorectically assembled PANi disposed on a patterned electrode of an insulated template under applied voltages of about 5, 10 and 15 volts (V)

The invention also contemplates that assembly dimensions for a conducting polymer can be controlled by varying parameters such as, for example, electric field strength, deposition time and solution dielectric constants. In one embodiment, a conducting polymer can be assembled on a patterned electrode of a template to comprise widths and heights on the micro or nanoscale. The topography of the patterned electrode, for example, a raised or trenched topography, can also affect electrophoretic assembly dimensions for a conducting polymer. FIG. 8 comprises OM images of electrophorectically assembled PANi disposed on a patterned electrode of an insulated template under applied voltages of about 5, 10 and 15 V. As shown, the insulated templates 66 include patterned electrodes comprising interdigitated raised gold lines 68, each with a width of about 2 μm and spaced about 55 μm apart. A method of the invention can be performed to alternatingly charge the interdigitated raised gold lines of the templates in solutions comprising DMF, emeraldine base PANi and CSA. The interdigitated raised gold lines are alternatingly positively and negatively charged by a power source to provide an electric field in solution for the electrophoretic assembly of PANi 70 onto those lines of the templates that are negatively charged.

Figure 9:
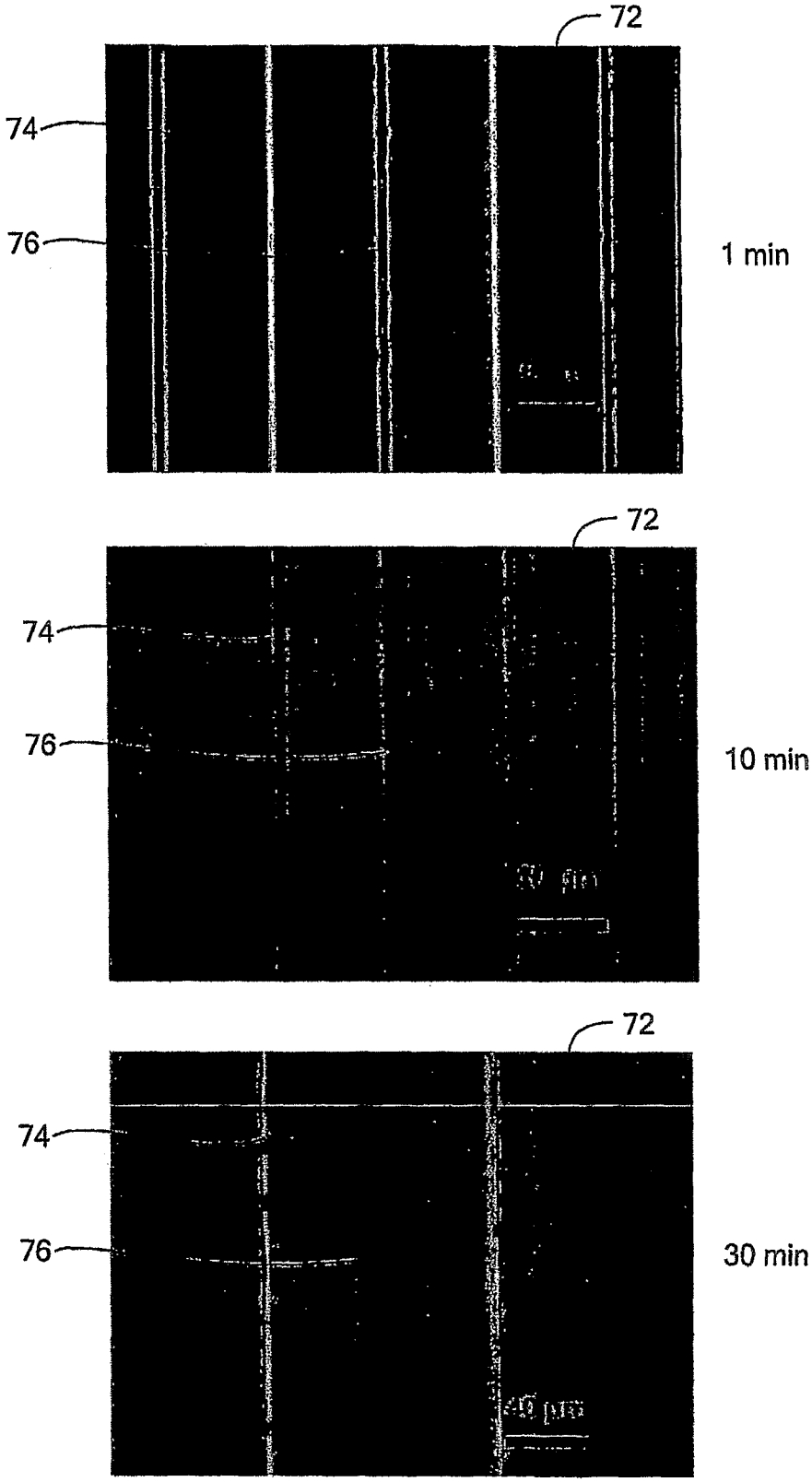
FIG. 9 comprises OM images of electrophorectically assembled PANi disposed on a patterned electrode of an insulated template during deposition times of about 1, 10 and 30 minutes (min)

The insulated templates 66 of FIG. 8 demonstrate the effect of controlling electric field strengths on the electrophorectic assembly of PANi 70 during a deposition time of about 10 min. As shown, FIG. 8 indicates that assembled PANi comprises greater widths and heights as applied voltage increases from about 5 to 15 V. Moreover, PANi is substantially uniform in its assembly along the lengths of the negatively charged interdigitated raised gold line as applied voltage increases from about 5 to 15 V. The assembled PANi is also predominately centered across the widths of the negatively charged interdigitated raised gold lines. In one embodiment, each of the insulated templates of FIG. 8 comprise an exemplary device of the invention. FIG. 9 also comprises OM images of electrophorectically assembled PANi disposed on a patterned electrode of an insulated template during deposition times of about 1, 10 and 30 min.

The insulated templates 72 of FIG. 9 include patterned electrodes comprising interdigitated raised gold lines 74, each with a width of about 2 μm and spaced about 55 μm apart. A method of the invention can be performed to alternatingly charge the interdigitated raised gold lines of the templates in solutions comprising DMF, emeraldine base PANi and CSA. The interdigitated raised gold lines are alternatingly positively and negatively charged by a power source to provide an electric field in solution for the electrophoretic assembly of PANi 76 onto those lines of the templates that are negatively charged. The insulated templates demonstrate the effect of controlling deposition time on the electrophorectic assembly of PANi under an applied voltage of about 10 V. As shown, FIG. 9 indicates that assembled PANi comprises greater widths and heights as deposition time increases from about 1 to 30 min. PANi is also substantially uniform in its assembly along the lengths of the negatively charged interdigitated raised gold line as deposition time increases from about 1 to 30 min.

FIG. 9 indicates that the assembly of PANi 76 is also predominately centered across the widths of the negatively charged interdigitated raised gold lines 74. In one embodiment, each of the insulated templates of FIG. 9 comprise an exemplary device of the invention. The invention also provides a method for transferring an assembled conducting polymer. A method of the invention comprises providing a substrate such as a polymeric substrate and contacting a surface of the substrate with an assembled conducting polymer. The assembled conducting polymer can be disposed on a patterned electrode of a template. Preferably, a method of the invention comprises removing the substrate. By removing the substrate, the assembled conducting polymer can be transferred, for example, completely transferred, from a patterned electrode of a template to the substrate. The invention also contemplates partially or substantially transferring the assembled conducting polymer to the substrate.

In one embodiment, a method for transferring an assembled conducting polymer comprises contacting an assembled conducting polymer with a polymeric substrate. The substrate can be compressed and heated to cure or evaporate solvents that are associated therewith. Preferably, the substrate can be cooled and peeled away from the assembled conducting polymer disposed on a patterned electrode of a template. The substrate can also be cast onto the assembled conducting polymer as a solution. A person of ordinary skill in the art can select a polymeric substrate such that the assembled conducting polymer adheres thereto more strongly than to the template. The assembled conducting polymer can then be transferred to the substrate in a pattern that corresponds to the patterned electrode of the template on which the polymer was assembled.

Figure 10:
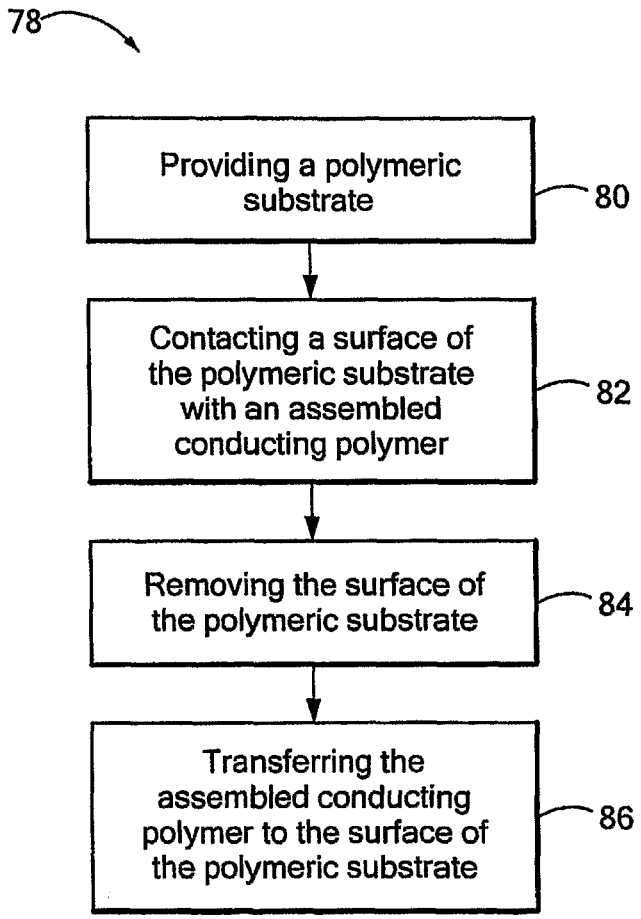
FIG. 10 represents an exemplary method of the invention for transferring an assembled conducting polymer.

FIG. 10 represents an exemplary method of the invention for transferring an assembled conducting polymer. As shown, the method 78 comprises providing a polymeric substrate in step 80. For example, the polymeric substrate can be, without limitation, a polystyrene, polyurethane, SBR, NBR, polyethylene, polyamide, polypropylene, polymethyl methacrylate, polycarbonate, polybutylene terephthalate, polyethylene terephthalate or poly(acrylonitrile-butadiene-styrene) substrate. Moreover, the substrate can comprise, without limitation, polystyrene, polyurethane, SBR, NBR, polyethylene, polyamide, polypropylene, polymethyl methacrylate, polycarbonate, polybutylene terephthalate, polyethylene terephthalate, poly(acrylonitrile-butadiene-styrene) or films thereof. The method also comprises contacting a surface of the polymeric substrate with an assembled conducting polymer in step 82. Preferably, the assembled conducting polymer is disposed on a patterned electrode of a template such as an insulated or sufficiently insulated template. In one embodiment, the substrate can be cast onto an assembled conducting polymer as a solution that forms or solidifies to comprise a surface in contact with the polymer. Exemplary solutions can also be compressed and heated or cured into a substrate. As the polymeric substrate remains in contact with the assembled conducting polymer, it can optionally be compressed and heated to cure or evaporate solvents associated therewith.

A polymeric substrate for a method of the invention can be compressed by standard processes including, without limitation, molding processes. For example, a conventional stamp can be used to contact a surface of the substrate. Preferably, the surface of the substrate in contact with a stamp differs from that disposed on an assembled conducting polymer. In one embodiment, solvents that are associated with a substrate can be cured or evaporated at ambient temperatures. Alternatively, a substrate can be heated to cure or evaporate solvents that are associated therewith. A method of the invention can also comprise cooling a substrate. The substrate can be cooled to provide for an efficient transfer of an assembled conducting polymer from a patterned electrode of a template.

In one embodiment, the substrate can be fluid-like comprising, without limitation, concentrated polymeric solutions, polymer melts or elastomeric materials such that a normal force can be applied uniformly across an area of contact with the assembled conducting polymer. For use of a polymeric solution to provide for the substrate, a solvent thereof preferably does not dissolve the assembled conducting polymer. Regarding polymer melts and transfer thereof, a melt temperature for the polymer should be lower than the degradation temperature of the assembled conducting polymer. Moreover, the modulus of an assembled conducting polymer at processing temperatures can be much higher than that of the materials for the substrate, which may prevent its deformation when a force is applied.

The method 78 of FIG. 10 also comprises removing the surface of the polymeric substrate in step 84. In one embodiment, the polymeric substrate can be removed from its relative adjacency to the template by standard processes such as peeling. As indicated, the assembled conducting polymer can be disposed on a patterned electrode of a template. Preferably, the substrate for the method of FIG. 10 can be selected such that an assembled conducting polymer adheres more strongly to it than to a template. The method also comprises transferring the assembled conducting polymer to the polymeric substrate in step 86. For example, the assembled conducting polymer can be transferred to the substrate in a pattern that corresponds to the patterned electrode of the template on which the polymer was assembled. The invention contemplates that transferring an assembled conducting polymer to a substrate can occur during removal of the substrate.

Figure 11:
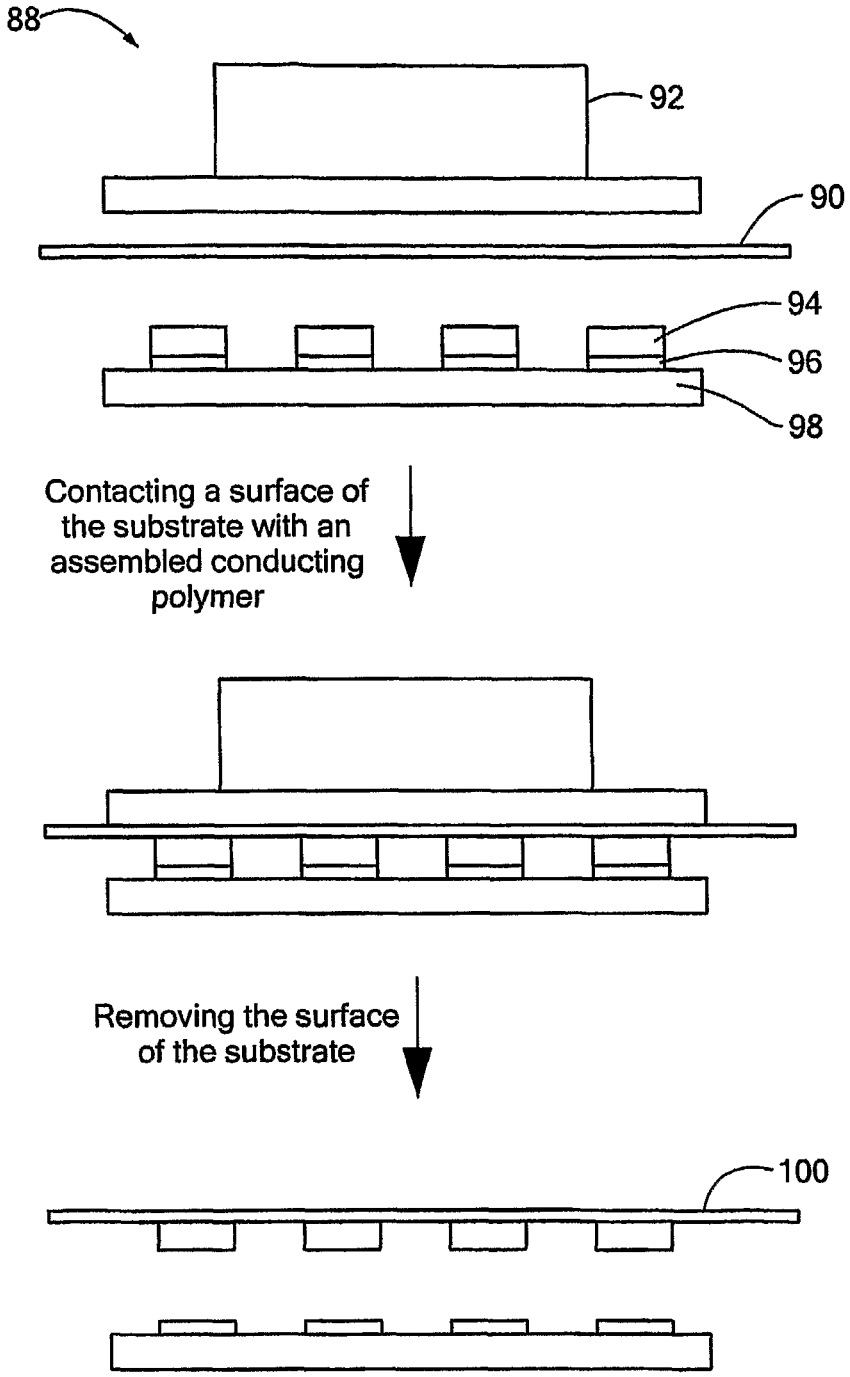
FIG. 11 represents an exemplary method and device of the invention.

A method for transferring an assembled conducting polymer can be performed to yield a device of the invention. For example, FIG. 11 represents an exemplary method and device of the invention. As shown, the method 88 comprises providing a substrate 90 such as a polymeric substrate and contacting a surface of the substrate with a conventional stamp 92. Moreover, the method provides contacting an assembled conducting polymer 94 with the substrate. In one embodiment, the substrate can be a polystyrene, polyurethane, SBR or NBR substrate. The assembled conducting polymer is disposed on a patterned electrode 96 of a template 98. Preferably, the template can be an insulated or sufficiently insulated template. The method also comprises removing the substrate. The substrate can be removed from its relative adjacency to the template. By removing the substrate from its relative adjacency to the template, the assembled conducting polymer can be transferred from the patterned electrode of the template to the substrate to yield a device 100 of the invention. The invention contemplates partially or substantially transferring the assembled conducting polymer to the substrate.

Figure 12:
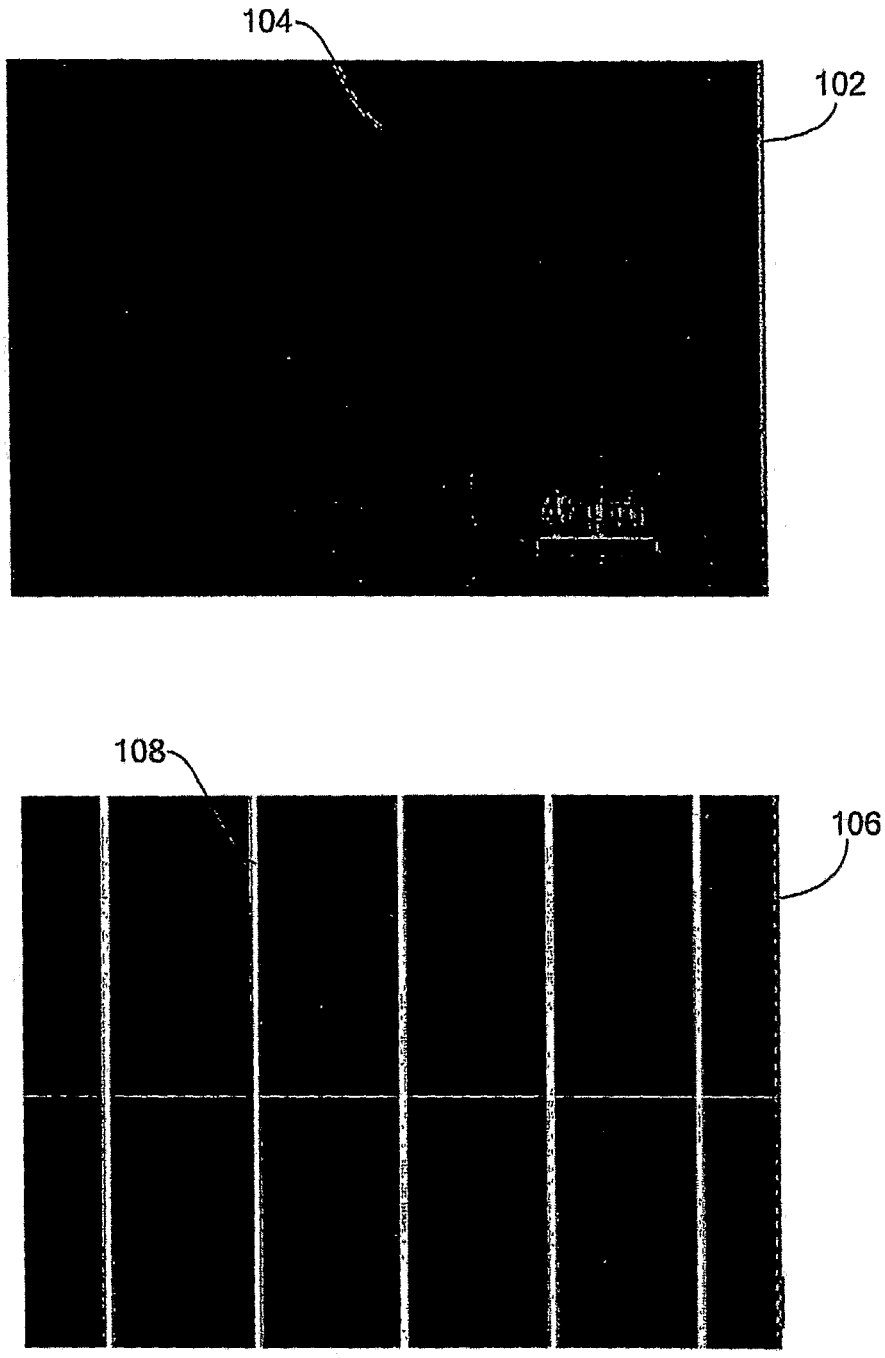
FIG. 12 comprises an OM image of assembled PANi transferred to a polyurethane substrate from an insulated template that includes a patterned electrode.

FIG. 12 comprises an OM image of assembled PANi transferred to a polyurethane substrate from an insulated template that includes a patterned electrode. As shown, the polyurethane substrate 102 comprises assembled PANi 104. The invention contemplates partially or substantially transferring the assembled PANi to the polyurethane substrate. By a method of the invention for transferring an assembled conducting polymer, FIG. 12 demonstrates that assembled PANi can be transferred from an insulated template 106 to the polyurethane substrate. For example, the polyurethane substrate was cast to form a surface in contact with the assembled PANi. The insulated template of FIG. 12 also includes a patterned electrode 108 comprising interdigitated raised gold lines.

Initially, PANi had been electrophoretically assembled on each of the negatively charged interdigitated raised gold lines through a method of the invention for directed assembly of a conducting polymer. The interdigitated raised gold lines each comprise a width of about 2 μm and can be spaced about 55 μm apart. The polyurethane substrate 102 of FIG. 12 also indicates that assembled PANi 104 can be generally uniform in its transfer thereto from the template 106. As shown, assembled PANi can be entirely or substantially transferred from the template by a method of the invention. Preferably, the assembled PANi can be transferred to the polyurethane substrate in a pattern that corresponds to the patterned electrode of the template on which the polymer was assembled. The polyurethane substrate comprising PANi also comprises a device of the invention.

Figure 13:
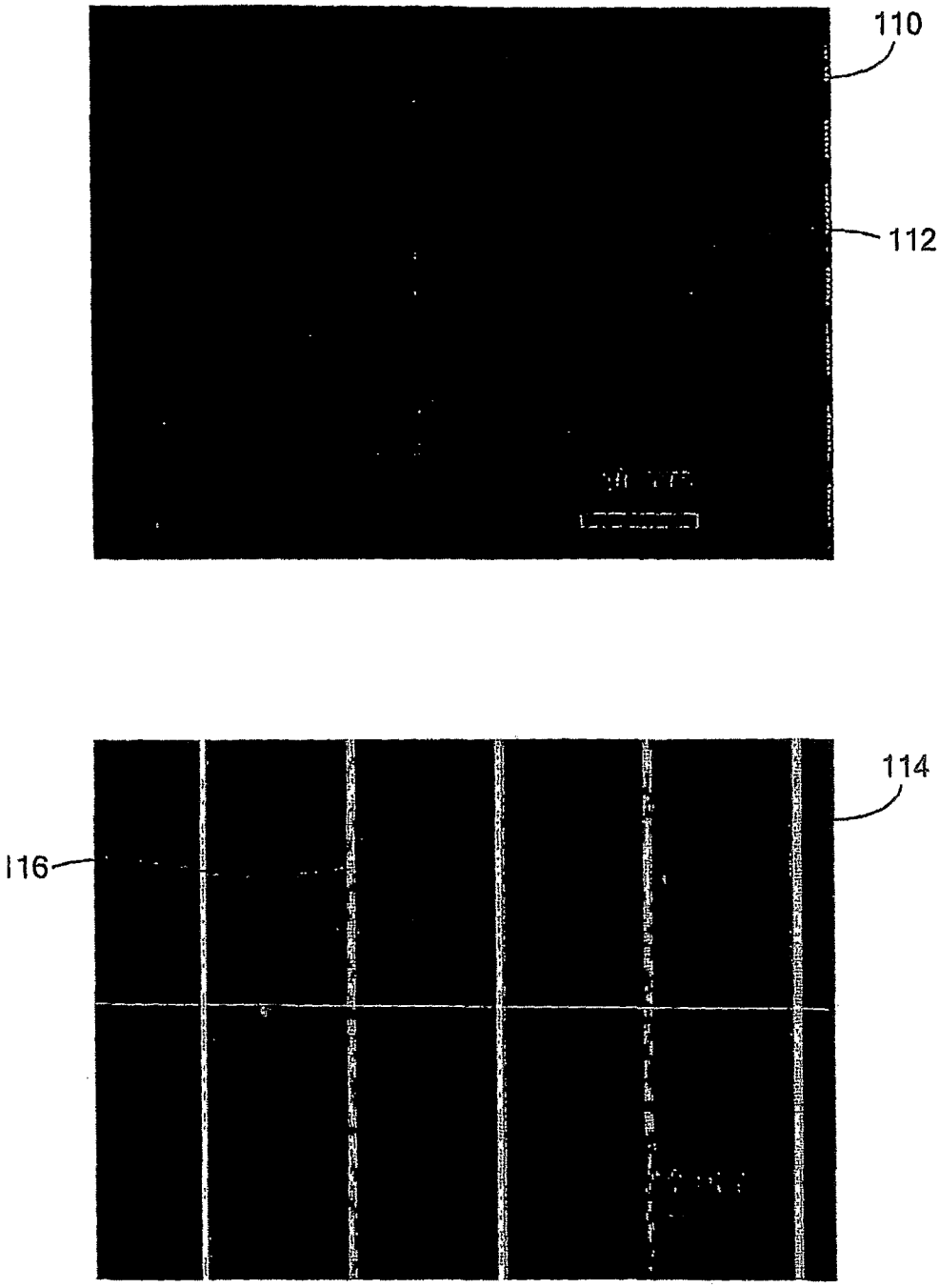
FIG. 13 comprises an OM image of assembled PANi transferred to a vulcanized styrene-butadiene rubber (SBR) substrate from an insulated template that includes a patterned electrode.

Moreover, FIG. 13 comprises an OM image of assembled PANi transferred to a SBR substrate from an insulated template that includes a patterned electrode. As shown, the SBR substrate 110 comprises assembled PANi 112. The invention contemplates partially or substantially transferring the assembled PANi to the SBR substrate. By a method of the invention for transferring an assembled conducting polymer, FIG. 13 demonstrates that assembled PANi can be transferred from an insulated template 114 to the SBR substrate. For example, the SBR substrate was compressed in contact with the assembled PANi by a standard molding process. The insulated template of FIG. 13 also includes a patterned electrode 116 comprising interdigitated raised gold lines.

In one embodiment, PANi had been electrophoretically assembled on each of the negatively charged interdigitated raised gold lines through a method of the invention for directed assembly of a conducting polymer. The interdigitated raised gold lines each comprise a width of about 2 μm and can be spaced about 55 μm apart. The SBR substrate 110 of FIG. 13 also indicates that assembled PANi 112 can be generally uniform in its transfer thereto from the patterned electrode 116 of the template 114. As shown, assembled PANi can be entirely or substantially transferred from the template by a method of the invention. Preferably, the assembled PANi can be transferred to the SBR substrate in a pattern that corresponds to the patterned electrode of the template on which the polymer was assembled. The SBR comprising PANi also comprises a device of the invention.

Figure 14:
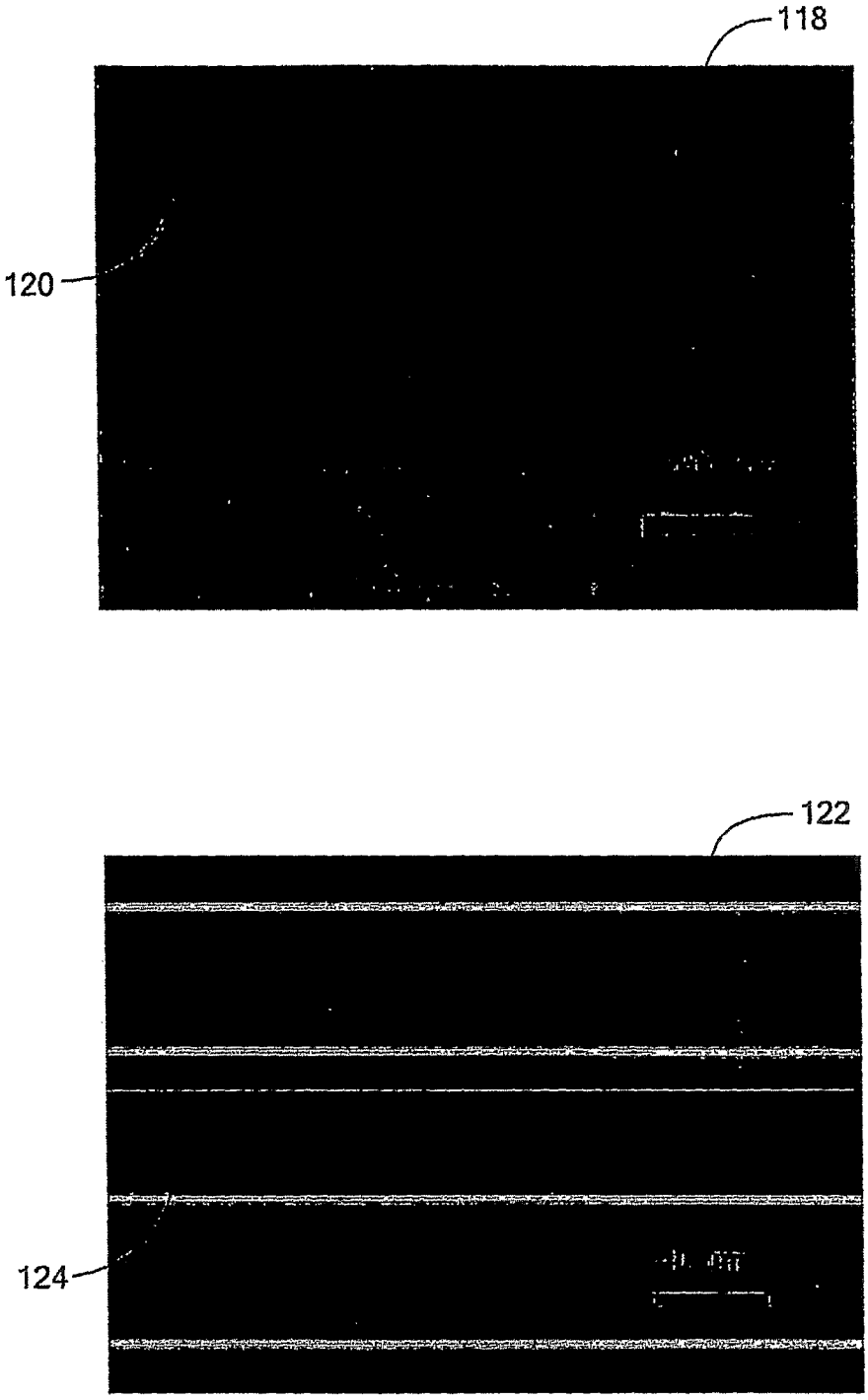
FIG. 14 comprises an OM image of assembled PANi transferred to a vulcanized acrylonitrile-butadiene rubber (NBR) substrate from an insulated template that includes a patterned electrode.

FIG. 14 comprises an OM image of assembled PANi transferred to a NBR substrate from an insulated template that includes a patterned electrode. As shown, the NBR substrate 118 comprises assembled PANi 120. The invention contemplates partially or substantially transferring the assembled PANi to the NBR substrate. By a method of the invention for transferring an assembled conducting polymer, FIG. 14 demonstrates that assembled PANi can be transferred from an insulated template 122 to the NBR substrate. For example, the NBR substrate was compressed in contact with the assembled PANi by a standard molding process. The insulated template of FIG. 14 also includes a patterned electrode 124 comprising interdigitated raised gold lines.

Preferably, PANi had been electrophoretically assembled on each of the negatively charged interdigitated raised gold lines through a method of the invention for directed assembly of a conducting polymer. The NBR substrate 118 of FIG. 14 also indicates that assembled PANi 120 can be generally uniform in its transfer thereto from the patterned electrode 124 of the template 122. As shown, assembled PANi can be entirely or substantially transferred from the template by a method of the invention. Preferably, the assembled PANi can be transferred to the NBR substrate in a pattern that corresponds to the patterned electrode of the template on which the polymer was assembled. The NBR substrate that includes PANi also comprises a device of the invention.

A method of the invention can comprise providing a template such as an insulated or sufficiently insulated template and electrophorectically assembling a conducting polymer thereon. Preferably, the template comprises a patterned electrode on which the conducting polymer is assembled. A method also comprises providing a substrate such as a polymeric substrate and contacting a surface thereof with the assembled conducting polymer disposed on the template. The substrate can also be removed, transferring the polymer from the patterned electrode of the template to the surface of the substrate.

Given that PANi can dissolve poorly in various organic solvents, a method of the invention can comprise solution casting performed at room temperature. For example, a substrate comprising polyurethane can be useful for an exemplary method or device of the invention as it is flexible and strongly polar, which provides strong adhesion to PANi. In one embodiment, a method of the invention can use a standard molding process for compression. The invention also contemplates that standard molding processes can be easily scaled for commercial applications. Preferably, SBR and NBR substrates may be compressed by a molding process as these substrates are flexible and can require low processing temperatures. These substrates can also generally retain their shape after curing. The greater polarity of an NBR substrate as compared to an SBR substrate can result in a more efficient transfer of an assembled conducting polymer such as PANi.

In one embodiment, a conducting polymer can be assembled onto a patterned electrode of a template by using an electric field. An electric field can accelerate the assembly of a conducting polymer as compared to conventional approaches. Furthermore, an electric field offers easy control by duty cycling, providing opportunities for high throughput. Preferably, the exemplary devices of the invention can be used in micro and nanoscale applications such as, for example, high rate micro or nanomanufacturing of a FET, paper-like or colorful thin display, organic photovoltaic cell, plastic circuit or biosensor.

For a method of the invention, conducting PANi can be doped by CSA and dissolved in DMF such that it can be selectively assembled on a negatively charged patterned electrode of a template. Electrophorectically assembling a conducting polymer can avoid complicated standard chemistry techniques such as those requiring functionalization of a substrate. A method of the invention also allows for a template to be reused, which can reduce cost and increase overall efficiencies in various applications. The examples herein are provided to illustrate advantages of the present invention that have not been previously described and to further assist a person of ordinary skill in the art with performing the methods herein. The examples can include or incorporate any of the variations or embodiments of the invention described above. The embodiments described above may also further each include or incorporate the variations of any or all other embodiments of the invention.

EXAMPLE I

Materials

Emeraldine base PANi (molecular weight 65,000 grams mole$^{-1}$), (1S)-(+)-(10)-CSA, polystyrene (molecular weight 280,000 grams mole$^{-1}$), DMF (99.9 percent reagent grade) and DCP (98 percent) were purchased from Aldrich Chemical (Sigma-Aldrich Company). These materials were used as received without additional purification. Polyurethane (Estane PE-LD4 from BF Goodrich Chemical), NBR (grade 40-5, Zeon Chemical) and SBR (grade 1502 with a styrene content of 56 percent, Ameripol-Synpol Company) were also employed as substrate materials for transferring an assembled conducting polymer via a method of the invention.

Template Fabrication

Metal electrodes were fabricated by depositing 6 nm and 40 nm of chromium and gold, respectively, on a silicon oxide wafer or 150 nm thick silicon oxide layer followed by standard etch processes. The interdigitated raised gold lines of the patterned electrode were spaced about 55 μm. Similarly, each interdigitated raised gold line comprised a width of about 2 μm. The interdigitated gold lines comprise a patterned electrode for a template that can be used in a method or device of the invention.

Solution Preparation

The 0.2 weight percent doped PANi solution was prepared by dissolving PANi and CSA with a ratio of 1:1 in DMF. The mixture was stirred for about 6 hours followed by an additional hour. Prior to use, the solution was filtered using Grade 5 WHATMAN filter paper to remove small particles.

Electrostatic Assembly

A template was rinsed with acetone for 15 min followed by ethanol for 10 min before use for a method of the invention. The filtered PANi solution was placed into a 50 milliliter (ml) beaker. The template connected with a DC power supply was immersed into the solution. The voltage applied by the power source was varied to about 10 V and immersion time spanned from about 1 min. After electrophoretic assembly was completed, the template with applied voltage was rinsed gently using deionized water and dried in air to yield a device of the invention. Furthermore, the template comprising assembled PANi was also examined using an OM (ML-26, Bausch & Lomb) and AFM (Model XE-150, 40 Newton m$^{-1}$ tip spring constant, 10 by 10 μm scan rate).

EXAMPLE II

Transfer of Assembled PANi onto Polystyrene and Polyurethane Substrates

The assembled PANi was transferred over to polystyrene and polyurethane substrates using solution casting. For example, 10 weight percent toluene solution of polystyrene and 10 weight percent tetrahydrofuran (THF) solution of polyurethane were cast onto templates by a method of the invention. The template was covered with a large beaker to decrease the evaporation speed of the solvent. After the solvent had evaporated, the polyurethane substrate was carefully peeled from the template using tweezers to yield a device of the invention. Similarly, the rigid polystyrene film was also removed by immersing the template in water for one day, which can yield a device of the invention comprising an assembled conducting polymer.

Transfer of Assembled PANi onto SBR and NBR Substrates

The assembled PANi was transferred over to SBR and NBR substrates via compression molding. For example, SBR and NBR compounds were prepared by mixing each with 2 parts per hundred rubber (phr) DCP (curing agent) using a BRABENDER internal mixer. The mixing speed and time were set at 40 revolutions per min (rpm) and 5 min, respectively. The compounding temperature was 70° C. for SBR and 80° C. for NBR. The compounds were each put against a template comprising assembled PANi in a compression molding cavity. The molds were then compressed at 1.5 megapascals (MPa) and 150° C. for 20 min. After the compounds were cured, the molds were cooled down rapidly as the compression pressure was still applied. Finally, the cured transparent substrates were peeled slowly off the templates to yield devices of the invention, which can comprise an assembled conducting polymer.

EXAMPLE III

Materials

PEDOT (2.8 weight percent dispersion in water) was purchased from Aldrich Chemical (Sigma-Aldrich Company) and used as received without additional purification.

Template Fabrication

A template was fabricated by depositing 6 nm, 40 nm and 150 nm of chromium, gold and polymethylmethacrylate (PMMA) resist, respectively, on a silicon oxide wafer followed by electron beam lithography and reactive ion etching to remove the PMMA resist, forming a trenched topography for the patterned electrode. For example, each trench comprised, without limitation, a width from about 300 to 400 nm. Exemplary trenches for a patterned electrode of a template can comprise widths from about 1 nm to 1,000 μm. Moreover, trenches for a patterned electrode can be spaced from, without limitation, about 1 nm to 1,000 μm apart.

Electrostatic Assembly

The template connected with a DC power supply was immersed into an aqueous solution comprising PEDOT. The voltage applied by the power source was about 5 V. Similarly, the immersion time was about 30 seconds. After assembly was completed, the template with applied voltage was rinsed gently using deionized water and dried in air to yield a device of the invention. The template comprising assembled PANi was also examined using a FESEM by JEOL.

Transfer of PEDOT

The assembled PEDOT was transferred over to a polyurethane substrate using solution casting with an about 10 weight percent THF solution of polyurethane. The template was also covered with a beaker to decrease the evaporation speed of the solvent. After the solvent evaporated, the polyurethane substrate was carefully peeled off from the template using tweezers.

Figure 15:
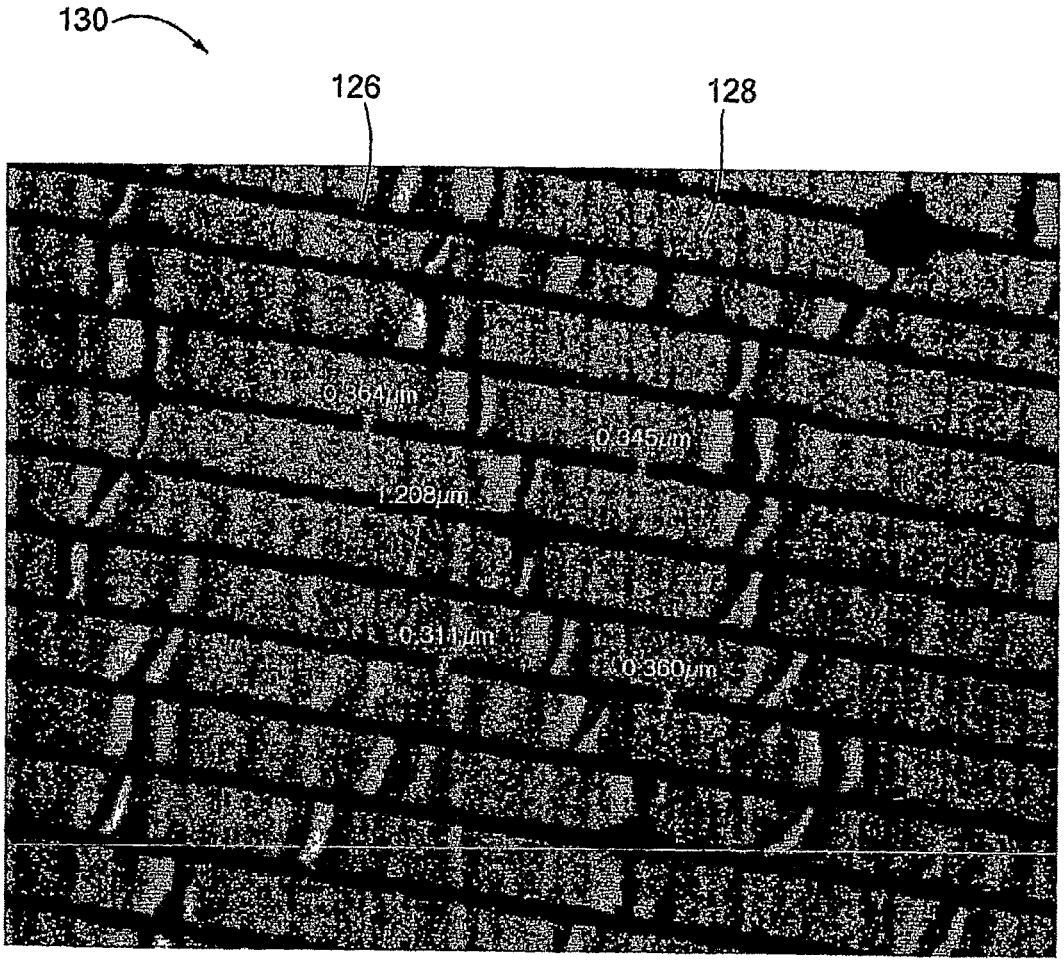
FIG. 15 includes field emission scanning electron microscope (FESEM) images of a polyurethane substrate comprising assembled PEDOT transferred from a template that includes a patterned electrode.

PEDOT bears a negative charge, driving it towards oppositely charged trenches of the patterned electrode such as those comprising positively charged gold. After the assembly of PEDOT onto the template, a polyurethane substrate was used to transfer the polymer along the trenches of the patterned electrode. FIG. 15 includes FESEM images of a polyurethane substrate comprising assembled PEDOT transferred from a template that includes a patterned electrode. As shown, assembled PEDOT 126 with widths of about 300 nm were formed on the flexible polyurethane substrate 128. The curve perpendicular to the assembled PEDOT resulted from the stretching of the substrate as it was peeled from template due to the flexibility thereof. In one embodiment, FIG. 15 comprises a device 130 of the invention. Preferably, the device can be a nanoscale device.

EXAMPLE IV

Conductivity Measurement

The conductivity of assembled PANi on a polyurethane substrate was measured by a micromanipulator (Serial Number 820243, Micromanipulator Company) with a 1 μm delicate probe and 487 Picoammeter voltage$^{-1}$ source (Keithley). The conductivity of the assembled PANi on the substrate was as high as 0.87 siemens (S) cm$^{-1}$.

EXAMPLE V

Before template fabrication, wafers were chemically cleaned to remove particulate matter on the surface including organic, ionic and metallic contaminants. A typical cleaning process is presented in Table 1. After each cleaning process, the wafer can be rinsed using deionized water for 5 min to remove all traces of ionic, particulate and bacterial contamination. The resistivity of typical deionized water was also about 18 mega ohm-cm. Facility was wet bench.

TABLE 1

| Standard diffusion wafer cleaning procedure |
|---|
| Removal of organic contaminants and some metals |
| 10 min in Piranha bath sulfuric acid:hydrogen peroxide ($H_2SO_4$:$H_2O_2$) (2:1) at 90° C.<br>5 min rinse in deionized water |
| Heavy metal clean |
| 10 min in water:hydrogen peroxide:hydrochloric acid ($H_2O$:$H_2O_2$:HCl) (6:1:1) at 70° C.<br>5 min rinse in deionized water |

TABLE 1-continued

| Standard diffusion wafer cleaning procedure |
|---|
| Oxide Removal |
| 5 to 15 seconds in water:hydrofuran ($H_2O$:HF) (10:1)<br>10 min rinse in deionized water |
| Thermal Oxidation |
| 150 nm thick silicon dioxide layer is thermally grown using a Bruce Furnace 7355B |

Metal Thin Layer Deposition

About 6 nm and from about 36 to 80 nm of chromium and gold, respectively, were deposited on the cleaned 3 inch wafer by sputtering. For example, chromium deposition was performed by applying a high voltage from about 100 to 110 V across a low-pressure argon gas at about 12 millitorr, creating a plasma that consists of electrons and gas ions in a high-energy state. The gold deposition was performed via radiofrequency and magnetron sputtering at 300 watts (W). Facility was MRC-8667.

Photolithography and Photoresist Development

Photomask was designed using AutoCAD and made by Photronics, Incorporated. Photoresist (Shipley 1813-1818) was spun coated on the 3 inch gold substrate at 3000 rpm for 1 min followed by a prebake at 115° C. for 1 min. The photoresist coated wafer was loaded onto a Quintel mask aligner for ultraviolet (UV) exposure. Contact mode was selected and exposure time was 7 seconds. The exposed photoresist was developed in MF-319 (Shipley) for 40 seconds and rinsed in deionized water for 5 min. The micropattern from the photomask was then transferred to the photoresist film. Facility was Brewer 100 CB Photoresist Spinner-Bake and Quintel 4000-6.

Dry Etch

The photoresist patterned wafers were further etched using an ion mill etch at an etch power of 250 W for 8 to 10 min, removing the gold and chromium away down to the silicon oxide substrate. Facility was Veeco Microetch.

Photoresist Removal

After dry etch, the wafers were submerged in a photoresist stripper (Shipley 1165, heated at 130° C.) for about 10 to 40 min. A longer time and, possibly, ultrasonics treatment may be necessary for using alternate strippers such as Shipley 1813.

Wafer Dicing

After photoresist removal, the patterned wafer was spun coated with a thin layer of photoresist (1813-1818) as a protection layer and diced into small chips using a dicing saw. Facility was MicroAutomation 1006.

While the present invention has been described herein in conjunction with a preferred embodiment, a person with ordinary skill in the art, after reading the foregoing specification, can effect changes, substitutions of equivalents and other types of alterations to the methods as set forth herein. Each embodiment described above can also have included or incorporated therewith such variations as disclosed in regard to any or all of the other embodiments. For example, a method of the invention can comprise both directed assembly of a conducting polymer and transferring the assembled polymer onto the surface of a substrate such as a polymeric substrate. Thus, it is intended that protection granted by Letter Patent hereon be limited in breadth and scope only by definitions contained in the appended claims and any equivalents thereof.

What is claimed is:

1. A method for directed assembly of a conducting polymer comprising: providing a template comprising a patterned electrode having a lithographically formed trenched topography in a layer of photoresist material disposed on a metal layer; and electrophoretically assembling a conducting polymer on the patterned electrode of the template wherein the template is sufficiently insulated beneath the patterned electrode to provide for selective electrophoretic assembly of the conducting polymer on the patterned electrode of the template and to substantially prevent deposition of the conductive polymer on other areas of the template.

2. The method of claim 1, wherein the conducting polymer comprises PEDOT, poly(acetylene), poly (diacetylene), poly (pyrrole), PANi, poly(thiophene), poly(p-phenylene), poly (azulene) or poly(equinoline).

3. The method of claim 1, wherein the metal layer of the patterned electrode comprises gold.

4. A method for directed assembly of a conducting polymer and transferring an assembled conducting polymer comprising: providing a template comprising a patterned electrode having a lithographically formed trenched topography in a layer of photoresist material disposed on the metal layer, electrophoretically assembling a conducting polymer on the patterned electrode of the template to obtain an assembled conducting polymer; polymerizing a polymeric substrate, onto the assembled conducting polymer by solution casting; and removing the polymeric substrate, wherein the assembled conducting polymer is transferred from the patterned electrode of the template to a surface of the polymeric substrate, and wherein the template is sufficiently insulated beneath the patterned electrode to provide for selective electrophoretic assembly of the conducting polymer on the patterned electrode of the template and to substantially prevent deposition of the conductive polymer on other areas of the template.

5. The method of claim 4, wherein the conducting polymer comprises PEDOT, poly(acetylene), poly(diacetylene), poly (pyrrole), PANi, poly(thiophene), poly(p-phenylene), poly (azulene) or poly(quinolone).

6. The method of claim 4, wherein the patterned electrode comprises gold.

7. The method of claim 4 wherein the polymeric substrate comprises polystyrene, polyurethane, SBR, NBR, polyethylene, polyamide, polypropylene, polymethyl methacrylate, polycarbonate, polybutylene terephthalate, polyethylene terephthalate or poly(acrylonitrile-butadiene-styrene).

8. A method for directed assembly of a polyelectrolyte comprising: providing a template comprising a patterned electrode; and electrophoretically assembling a polyelectrolyte on the patterned electrode of the template, wherein the patterned electrode has a lithographically formed trenched topography in a layer of photoresist material disposed on a metal layer, and wherein the template is sufficiently insulated beneath the patterned electrode to provide for selective electrophoretic assembly of the conducting polymer on the patterned electrode of the template and to substantially prevent deposition of the conductive polymer on other areas of the template.

9. The method of claim 8, wherein the polyelectrolyte comprises poly(acrylic acid), poly(allylamine hydrochloride), polyamidoamine, poly(ethylene imine), poly (thiophene acetic acid), poly(azobenzene), poly(p-phenylene vinylene), sulfonated polystyrene, poly(methacrylic acid), poly(vinyl pyrrolidone) or poly(vinyl sulfonic acid).

10. The method of claim 8, wherein the patterned electrode comprises gold.

11. A method for directing assembly of a polyelectrolyte and transferring an assembled polyelectrolyte comprising: providing a template comprising a patterned electrode having a lithographically formed trenched topography in a layer of photoresist material disposed on a metal layer; electrophoretically assembling a polyelectrolyte on the patterned electrode of the template to obtain an assembled polyelectrolyte, wherein the template is sufficiently insulated beneath the patterned electrode to provide for selective electrophoretic assembly of the polyelectrolyte on the patterned electrode of the template and to substantially prevent deposition of the polyelectrolyte on other areas of the template; polymerizing a polymeric substrate onto the assembled polyelectrolyte by solution casting; and removing the polymeric substrate, wherein the assembled polyelectrolyte is transferred from the patterned electrode of the template to the surface of the polymeric substrate.

* * * * *